US006858365B2

(12) United States Patent
Sawada et al.

(10) Patent No.: US 6,858,365 B2
(45) Date of Patent: Feb. 22, 2005

(54) TONER FOR DEVELOPING ELECTROSTATIC LATENT IMAGE, DEVELOPING METHOD AND DEVELOPING APPARATUS

(75) Inventors: Toyoshi Sawada, Odawara (JP); Masanori Suzuki, Suntoh-gun (JP); Kohki Katoh, Suntoh-gun (JP); Yohichiroh Watanabe, Fuji (JP); Keiko Shiraishi, Susono (JP); Takuya Saito, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 10/102,629

(22) Filed: Mar. 22, 2002

(65) Prior Publication Data

US 2003/0039909 A1 Feb. 27, 2003

(30) Foreign Application Priority Data

Mar. 23, 2001 (JP) ..... 2001-086073

(51) Int. Cl.[7] ..... G03G 9/00

(52) U.S. Cl. ..... 430/106.2; 430/108.6; 430/109.4; 430/111.4

(58) Field of Search ..... 430/108.6, 108.7, 430/109.4, 111.4, 108.1, 106.2

(56) References Cited

U.S. PATENT DOCUMENTS

| | | | | |
|---|---|---|---|---|
| 5,736,288 | A * | 4/1998 | Kasuya et al. | 430/106.2 |
| 6,004,715 | A | 12/1999 | Suzuki et al. | |
| 6,074,794 | A | 6/2000 | Fushimi et al. | |
| 6,074,795 | A | 6/2000 | Watanabe et al. | |
| 6,103,441 | A | 8/2000 | Tomita et al. | |
| 6,168,894 | B1 | 1/2001 | Aoki et al. | 430/99 |
| 6,180,298 | B1 | 1/2001 | Kuroda et al. | 430/45 |
| 6,183,926 | B1 | 2/2001 | Kuroda et al. | |
| 6,212,351 | B1 | 4/2001 | Kawagoe et al. | 399/302 |
| 6,258,502 | B1 | 7/2001 | Nakamura et al. | 430/106.6 |
| 6,269,228 | B1 | 7/2001 | Kayahara et al. | 399/37 |
| 6,303,258 | B1 | 10/2001 | Katoh et al. | 430/110.1 |
| 6,335,137 | B1 | 1/2002 | Suzuki et al. | 430/110.1 |
| 6,363,229 | B1 | 3/2002 | Shiraishi et al. | 430/124 |
| 6,405,002 | B2 | 6/2002 | Ogiyama et al. | 399/101 |
| 6,445,900 | B2 | 9/2002 | Fukao et al. | 399/302 |
| 6,449,453 | B1 | 9/2002 | Motohashi | 399/302 |
| 6,468,706 | B2 | 10/2002 | Matsuda et al. | 430/108.6 |
| 6,505,014 | B2 | 1/2003 | Aoki et al. | 399/55 |
| 6,505,024 | B2 | 1/2003 | Kayahara et al. | 399/302 |
| 2003/0036010 | A1 * | 2/2003 | Suzuki et al. | 430/106.2 |

OTHER PUBLICATIONS

U.S. Appl. No. 10/079,878, filed Feb. 22, 2002, Pending.
U.S. Appl. No. 09/993,606, filed Nov. 27, 2001, Pending.
U.S. Appl. No. 09/891,652, filed Jun. 26, 2001.
U.S. Appl. No. 10/151,103, filed May 21, 2002, Pending.
U.S. Appl. No. 10/077,752, filed Feb. 20, 2002, Pending.
U.S. Appl. No. 10/098,556, filed Mar. 18, 2002, Pending.
U.S. Appl. No. 10/086,683, filed Mar. 4, 2002, Pending.
U.S. Appl. No. 09/820,609, filed Mar. 30, 2001, Pending.
U.S. Appl. No. 09/964,622, filed Sep. 28, 2001, Pending.
U.S. Appl. No. 09/965,826, filed Oct. 1, 2001, Pending.
U.S. Appl. No. 10/251,855, Sep. 23, 2002, Pending.
U.S. Appl. No. 09/709,795, filed Nov. 10, 2000.
U.S. Appl. No. 09/696,959, filed Oct. 27, 2000.
U.S. Appl. No. 09/947,391, filed Sep. 7, 2001, Pending.
U.S. Appl. No. 09/960,922, filed Sep. 25, 2001, Pending.
U.S. Appl. No. 10/104,078, filed Mar. 25, 2002, Pending.
U.S. Appl. No. 10/114,056, filed Apr. 3, 2002, Pending.
U.S. Appl. No. 10/151,109, filed May 21, 2002, Pending.
U.S. Appl. No. 10/282,039, filed Oct. 29, 2002, Pending.
U.S. Appl. No. 09/826,789, filed Apr. 5, 2001.
U.S. Appl. No. 09/910,080, filed Jul. 23, 2001.
U.S. Appl. No. 09/943,505, filed Aug. 31, 2001, Pending.
U.S. Appl. No. 09/945,839, filed Sep. 5, 2001, Pending.
U.S. Appl. No. 09/948,576, filed Sep. 10, 2001, Pending.
U.S. Appl. No. 09/963,644, filed Sep. 27, 2001, Penidng.
U.S. Appl. No. 09/984,236, filed Oct. 29, 2001, Pending.
U.S. Appl. No. 09/983,687, filed Oct. 25, 2001, Pending.
U.S. Appl. No. 09/987,027, filed Nov. 13, 2001.
U.S. Appl. No. 09/988,142, filed Nov. 19, 2001, Pending.
U.S. Appl. No. 10/041,582, filed Jan. 10, 2002, Pending.
U.S. Appl. No. 10/050,959, filed Jan. 22, 2002, Pending.
U.S. Appl. No. 10/050,955, filed Jan. 22, 2002, Pending.
U.S. Appl. No. 10/054,993, filed Jan. 25, 2002, Pending.
U.S. Appl. No. 10/073,237, filed Feb. 13, 2002.
U.S. Appl. No. 10/075,402, filed Feb. 15, 2002, Pending.
U.S. Appl. No. 10/083,159, filed Feb. 27, 2002, Pending.
U.S. Appl. No. 10/107,249, filed Mar. 28, 2002, Pending.
U.S. Appl. No. 10/143,928, filed May 14, 2002, Pending.
U.S. Appl. No. 10/152,672, filed May 23, 2002, Pending.
U.S. Appl. No. 10/268,830, filed Oct. 11, 2002, Pending.
U.S. Appl. No. 10/163,530, filed Jun. 7, 2002, Pending.
U.S. Appl. No. 10/314,241, filed Dec. 9, 2002, Pending.
U.S. Appl. No. 10/752,589, filed Jan. 8, 2004, Masuda et al.
U.S. Appl. No. 10/766,874, filed Jan. 30, 2004, Yamashita et al.
U.S. Appl. No. 10/772,435, filed Feb. 6, 2004, Shiraishi, et al.
U.S. Appl. No. 10/793,320, filed Mar. 5, 2004, Higuchi, et al.

(List continued on next page.)

*Primary Examiner*—Janis L. Dote
(74) *Attorney, Agent, or Firm*—Oblon, Spivak, McClelland, Maier & Neustadt, P.C.

(57) ABSTRACT

A toner, a developing method and apparatus is provided to satisfy both the low temperature fixation property and the hot offset property and that has a wide range of fixing temperature. The toner for an image formation comprises at least metal materials in a binding resin, wherein the toner is measured by a stand-alone type flow tester, and has a softening temperature of 65~77.5° C., a flow beginning temperature of 100~120° C., a melt temperature by a ½ method is 145~195° C., and an average length of a short axis of a primary particle of the metal materials is 0.01~0.4 μm.

12 Claims, 5 Drawing Sheets

OTHER PUBLICATIONS

U.S. Appl. No. 10/802,866, filed Mar. 18, 2004, Saito, et al.
U.S. Appl. No. 10/800,636, filed Mar. 16, 2004, Hasegawa, et al.
U.S. Appl. No. 10/623,522, filed Jul. 22, 2003, Yamashita, et al.
U.S. Appl. No. 10/674,358, filed Oct. 1, 2003, Sugiyama, et al.
U.S. Appl. No. 10/670,320, filed Sep. 26, 2003, Watanabe et al.
U.S. Appl. No. 10/444,013, filed May 23, 2003, Sawada, et al.
U.S. Appl. No. 10/609,399, filed Jul. 1, 2003, Katoh et al.
U.S. Appl. No. 10/329,362, filed Dec. 27, 2002, Suzuki, et al.

* cited by examiner

TONER FOR DEVELOPING ELECTROSTATIC LATENT IMAGE, DEVELOPING METHOD AND DEVELOPING APPARATUS

CROSS-REFERENCE TO RELATED APPLICATION

This application claims the priority benefit of Japanese application serial no. 2001-086073, filed Mar. 23, 2001.

BACKGROUND OF THE INVENTION

1. Field of the Invention

This invention relates in general to a toner for forming an image, a developing method and a developing device. More specifically, the invention relates to an image formation toner that contains metal materials serving as the fixing aids and the coloring agent, a developing method and a developing device.

2. Description of Related Art

In general, as disclosed in U.S. Pat. No. 2,297,691, Japanese Laid Open S49-23910 and Japanese Laid Open S43-24748, the image formation of the electrophotography utilizes various methods to form an electric latent image on a photosensitive body that is made from a photo conductive material. After the electric latent image is developed by a developer, the image formed by the developer is transcribed onto a medium, such as a paper according to the requirement, and then the transcribed image is fixed by heating, pressing or solvent vaporizing.

The methods for developing the electric latent image can be roughly classified as follows. One is the liquid developing method and the other is the dry developing method. The liquid developing method uses a liquid developer that various colors and dyes are dispersed in an insulating organic liquid. The dry developing method uses a dry developer (a toner, hereinafter) that the coloring agent, such as the carbon black, is dispersed in a natural or a synthetic resin by the cascade method, the magnetic brush method, the powder cloud method etc. The dry developing method is widely used recently.

In general, a heat roller is widely used as a fixing method (fixation) for the dry development in consideration of the excellent energy efficiency. Lately, in order to save energy by the low temperature fixation of the toner, the heat energy provided to the toner during the fixation tends to become smaller. In 1999, the International Energy Association (IEA) published a specification required by a Demand-Side Management (DSM) program for the technology project of the next generation copy machine. In the specification, for a copy machine higher than 30 cpm, power consumption is lower than 10~30 Watts (dependent on the copy speed) within a standby time of 10 seconds. The energy is considerably saved in comparison with the conventional copy machine.

For the low temperature fixation property, a polyester resin that is superior in the low temperature fixation property and the thermal preservation resistance property has been tried to use to replace the conventional styrene-acryl resin (referring to Japan Laid Open S60-90344, S64-15755, H2-82267, H3-229264, H3-41470 and H11-305486 etc). However, even though the conventional well-known technology is suitable, it is impossible to achieve the specification of the DSM program. Research and study into the low temperature fixation is necessary for improving the conventional technology.

For low temperature fixation, the thermal properties of the resin have to be well controlled. However, when the glass transition temperature is reduced too much, the thermal preservation resistance property becomes worse. When the molecular weight is reduced and the softening temperature of the resin is lowered too much, the temperature where the hot offset occurs is reduced. Therefore, it is impossible to obtain a toner having an excellent low temperature property and a higher temperature for the hot offset.

For preventing the hot offset, it is well known that a releasing agent, such as the wax, can be included in the toner, and the wax is exuded from the toner during fixation (referring to Japan Laid Open H7-295290, H8-234480, H9-034163, H2000-56511, and Japan Patent No.2904520, etc). The releasing agent has to be dominant in the toner because it is easily exuded. However, the wax (releasing agent) on the surface of the toner particles becomes too great because of the dominance of the releasing agent, which causes problems with the preservation and the development properties. In particular, for a fixing system where the fixing unit (such as a heat roller) has a low heat capacity and the temperature response of the toner is increased, the surface pressure of the roller must be reduced for thinning the heat roller. Therefore, the releasing agent is hard to be exuded, and exuding is difficult because the releasing agent is dominant in the toner.

SUMMARY OF THE INVENTION

According to the foregoing description, an object of this invention is to provide a toner, a developing method and apparatus that satisfy both the low temperature fixation property and the hot offset property and have a wide range of fixing temperature, by which a very excellent result can be obtained.

According to the invention, metal particles are dispersed in the binding resin, and therefore an interaction similar to a metal bridging structure is formed between the binding resin and the metal material, and the metal material is used as a filler. Accordingly, it is not the control of the thermal property of the resin itself, but due to the dispersion of the metal particles, that the thermal property of the toner can be well controlled, such that a toner with excellent properties of low temperature fixation and hot offset can be obtained.

For achieving the above objects, the invention provides a toner for an image formation, which comprises at least one metal material in a binding resin. The toner as measured by a stand-alone type flow tester has a softening temperature of 65~77.5° C., a flow beginning temperature of 100~120° C., a melt temperature by a ½ method is 145~195° C., and an average length of a short axis of a primary particle of the metal material is 0.01~0.4 $\mu$m. The absolute specific gravity of the metal materials is 4.0~5.0 g/cm$^3$. The average length of a short axis of the primary particle of the metal materials is 0.01~0.1 $\mu$m. The absolute specific gravity of the toner is 1.35~1.6 g/cm$^3$. The at least one metal material have at least one type of compounds of elements of Mn, Ti, Cu, Si, or C on the surface of at least one of hematite, maghemite, or manganese oxide. The at least one metal material can have an anisotropic shape with an axial ratio above 2, or have an isotropic shape with a degree of sphericity less than 2. The amount of the at least one metal material is smaller than 50 weight-part with respect to a 100 weight-part of the binding resin. The toner can further comprise an additive that uses at least one silica and/or a titanium oxide. The binding resin comprises at least a polyester resin. The toner can further comprise a releasing agent, wherein the releasing agent comprises at least one wax selected from a carnauba wax of de-free fatty acid type, a montan wax, and a rice wax oxide. The average grain size per volume of the toner is 2.5~12 μm.

In addition, the invention further provides a toner container used for containing the toner for the image formation that is described above. The invention also provides an image forming method, using the toner aforementioned inside an image forming apparatus for developing an electrostatic latent image formed on an image supporter. The invention also provides an image forming apparatus, using the toner above for developing an electrostatic latent image formed on an image supporter.

BRIEF DESCRIPTION OF THE DRAWINGS

While the specification concludes with claims particularly pointing out and distinctly claiming the subject matter which is regarded as the invention, the objects and features of the invention, further objects, features and advantages thereof will be better understood from the following description taken in connection with the accompanying drawings in which:

DESCRIPTION OF THE PREFERRED EMBODIMENT

Following is the detail description according to the invention. The toner is a viscoelastic material and its fixation characteristic is determined by the thermal property (a ratio of the viscous component to the elastic component). The characteristics of a flow tester, a melt index and a rheometer etc. are used as an index of the thermal characteristic. Regarding the low temperature fixation, the elastic component is reduced at a low temperature, however, it is required so that the toner is deformed such that the toner is easily adhered on a printing material (paper for example). As for the offset resistance property, the elastic component becomes too small at a high temperature, however, it is required to maintain the cohesive force between the toners.

Figure 1A:
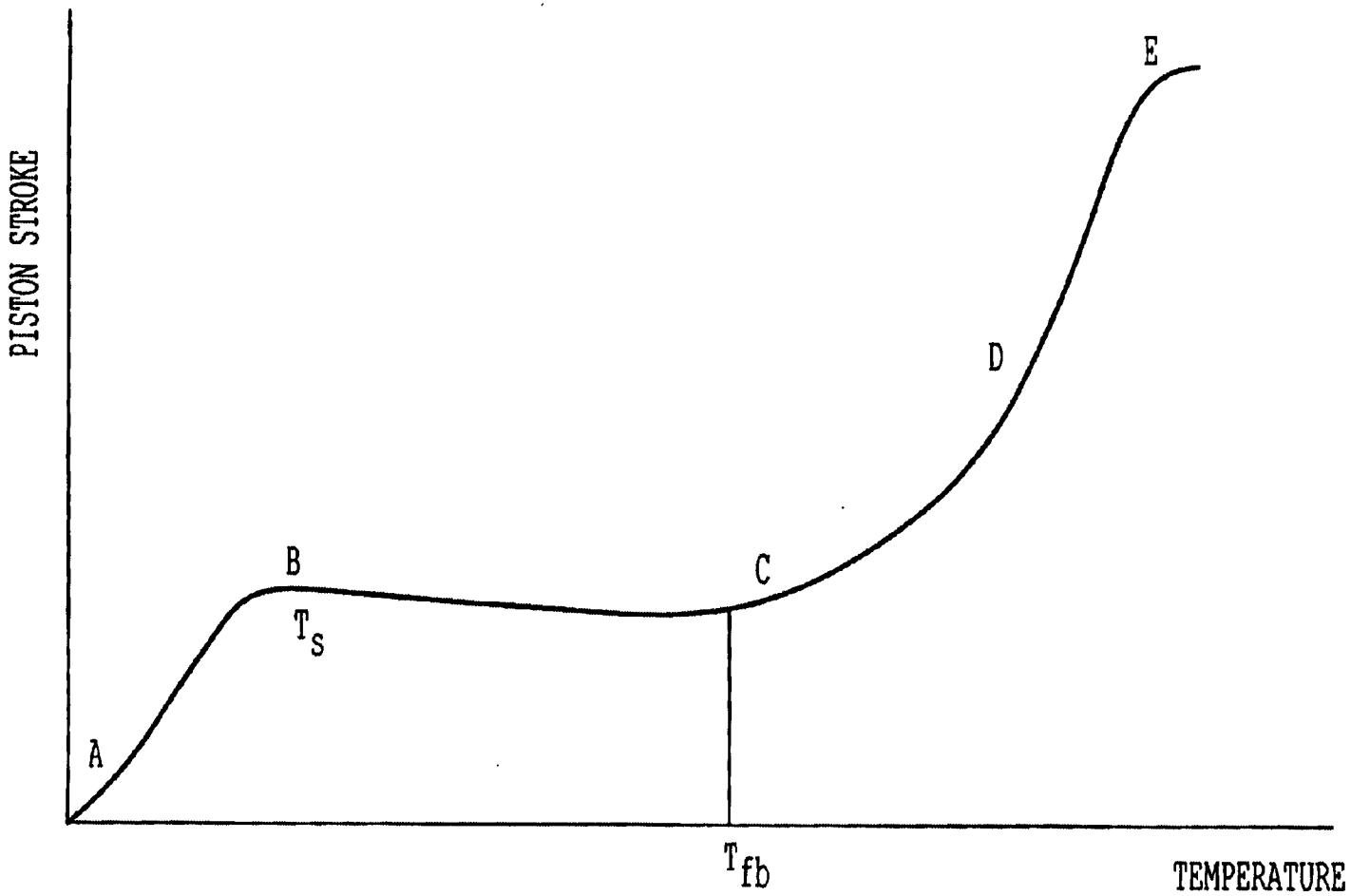
FIGS. 1A and 1B are temperature curves for calculating temperatures of the toner by a flow tester.
Figure 1B:
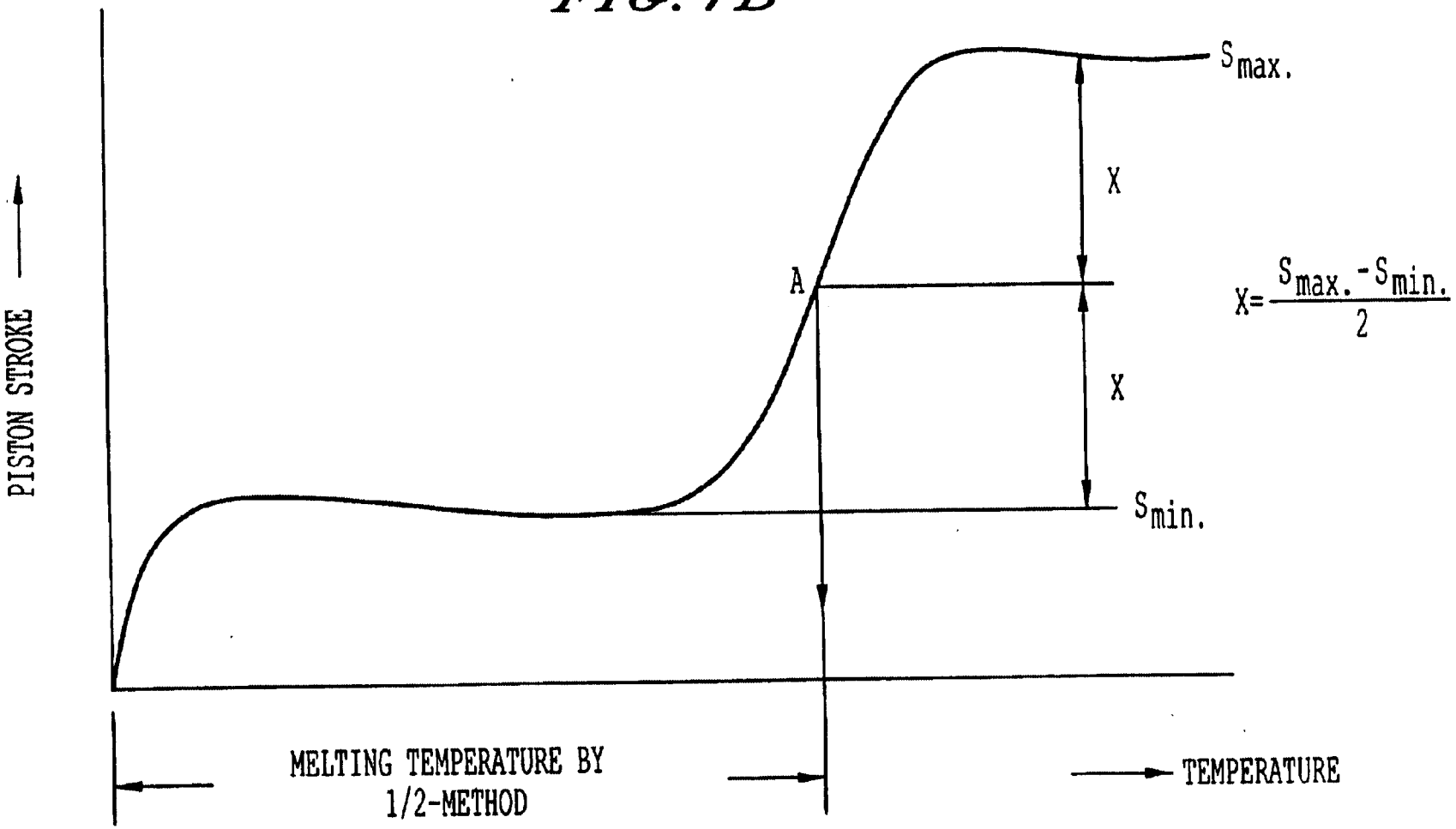

When the inventors studied the thermal characteristic obtained by the flow tester, an optimum temperature range was found from a temperature curve of the flow tester such that the low temperature fixation property and the offset resistance property can be satisfied as well as the range of the fixing temperature enlarged. The flow tester used here is a stand-alone type flow tester (CFT500 type) made by Shimadsu manufacturing company, which is similar to the usual flow tester. The temperature curve of the flow tester is shown in FIGS. 1A and 1B, from which various temperatures can be read out and obtained. In FIGS. 1A and 1B, Ts is the softening temperature (point) and Tfb is the flow beginning temperature (point). The melt temperature obtained by the ½ method is a F½ temperature (point).

According to the inventors' discovery, the temperature on the flow curve and the desired quality of the toner satisfies a relationship as shown in Table 1. One gram of toner is formed by pressing and used as a testing sample for measurements of the flow tester, and the measurements are performed under conditions such that the testing load is 10 kg/cm$^2$, the nuzzle diameter is 0.5 mm, the nuzzle length is 1 mm, and the temperature increment is 3° C./min.

According to the invention, particular metals are dispersed in the binding resin, and therefore an interaction similar to a metal bridging structure is formed between the binding resin and the metal material and the metal material is used as a filler. Accordingly, not by the control of the thermal property of the resin itself, but due to the dispersion of the metal particles, the thermal property of the toner can be well controlled, such that the temperature Ts, Tfb, F½ and the flow ending point can be within the optimum range in Table 1, by which a toner with properties of the low temperature fixation and the hot offset can be obtained.

TABLE 1

| Item | optimum temperature range | lower than the optimum temperature range | higher than the optimum temperature range |
|---|---|---|---|
| softening point | 65~77.5° C. | temperature that hot offset occurs is decreased, and the thermal preservation resistance is reduced | low limit of fixing temperature is increased |
| flow beginning point | 100~120° C. | temperature that hot offset occurs is decreased | low limit of fixing temperature is increased |
| F1/2 point | 145~195° C. | temperature that hot offset occurs is decreased | low limit of fixing temperature is increased |
| flow ending point | 160~120° C. | temperature that hot offset occurs is decreased | low limit of fixing temperature is increased |

Following are discussions of the thermal properties obtained from the rheometer. An index for increasing the width of the fixing temperature that satisfies the excellent properties of the low temperature fixation and the offset resistance can be found to point out an optimum range according to an elastic modulus G' and tanδ. According to the invention, the toner quality is correlated with the elastic modulus G' and tanδ, as shown in Tables 2 and 3. RHEOSTRESS RS50 system is used for the measurement of the rheometer. The measurement uses a parallel plate with a diameter of 20 mm and a gap of 2 mm and is performed at a frequency of 10 Hz, a temperature of 1000° C. or 1 800° C., and a stress of 1000~3000 Pa. The toner is a plate shape with a diameter of 20 mm and a thickness of 2 mm. In the invention, particular metals are dispersed in the binding resin, and therefore an interaction similar to a metal bridging structure is formed between the binding resin and the metal material, and the metal material is used as a filler. Accordingly, not by the control of the thermal property of the resin itself, but due to the dispersion of the metal particles, the thermal property of the toner can be well controlled, such that the elastic modulus G' and tanδ can be within the optimum range in Tables 2 and 3, by which a toner with properties of the low temperature fixation and the hot offset can be obtained.

TABLE 2

| Item | optimum range | outside optimum range |
|---|---|---|
| Stress 1500~2000 Pa, G' at 100° C. | $<5 \times 10^5$ Pa | low limit of fixing temperature is increased |
| stress 1000~1500 Pa, tanδ at 100° C. | >1.3 | low limit of fixing temperature is increased |
| Stress 1000~1500 Pa, G' at 180° C. | $>5 \times 10^2$ Pa | temperature that hot offset occurs is decreased |
| stress 1000~1500 Pa, tanδ at 180° C. | <5 | temperature that hot offset occurs is decreased |

The primary particles, used as the metal particles for controlling the thermal properties of the toner, have a short axis with an average length of about 0.01~0.4 μm, and the metal material having a short axis with an average length of about 0.01~0.1 μm is preferred. The variations of the thermal properties become large as the concentration of the metal material increases. Even though the amount of the metal material is the same, if the average short axis of the primary particle of the metal material is small, the specific surface area gets larger, and if the secondary condensation is difficult to occur, the dispersion becomes excellent. As a result, the variations of the thermal properties of the toner become large. As the contact area between the metal material and the binding resin becomes larger, the interaction between the metal material and the binding resin occurs easily. If the average length of the short axis of the material is larger than 0.4 μm, the thermal properties of the toner have no obvious variations.

The shape of the metal material can be an anisotropic shape (a needle shape, a spindle shape or a rice shape, etc) with an axial ratio (ratio of the average long axis and the average short axis) above 2, or an isotropic shape (a spherical shape, a octahedral shape, a hexahedral shape, or a grain shape, etc) with a degree of sphericity (ratio of the average longest radius and the average shorted radius) less than 2. However, in comparison with the metal material having the anisotropic shape, the filler effect can be easily found in the metal material having the isotropic shape, and the variations of the thermal properties of the toner become large. The average length of the short axis, the dispersion and the shape of the primary particles in the metal material can be measured by an electron microscope.

According to the toner of the invention, a metal materials have at least one type of compounds of elements of Mn, Ti, Cu, Si, or C on the surface of at least one of hematite, maghemite, or manganese oxide. In addition to a function as a fixing auxiliary for the filler effect and creating an interaction similar to a metal bridging structure, the metal material further possesses a function as a black coloring agent for replacing the carbon black because the metal material, by using the metal material above, can be black. The amount of the metal material is 5~50 weight parts with respect to 100 parts of the binding resin, and 10~25 weight parts is preferred. If the amount is below 5 weight parts, the coloring of the toner is lowered, and the filming effect occurs easily because the abrasive effect of the surface of the photosensitive material is not sufficient. If the amount is above 50 weight parts, the metal particles are agglomerated, and therefore the dispersion becomes worse and the fixation is degraded.

The absolute specific gravity of the metal material used in the invention is 4.0~5.0 g/cm$^3$ and preferably the absolute specific gravity of the toner is 1.35~1.6 g/cm$^3$. Because the metal material having an absolute specific gravity of about 4.0~5.0 g/cm$^3$ is used, the specific gravity difference between the binding resin and the metal material during a melting and mixing process (one of the steps for making the toner) becomes large, and therefore the metal material can be uniformly dispersed. Additionally, by using toner having an absolute specific gravity of 1.35~1.6 g/cm$^3$, because the toner can be easily captured in a pulverizing and a classifying processes, the productivity (pulverization) for the toner is superior.

Regarding a two component developing method, because the specific gravity difference between the toner and the carrier is small, the stirring efficiency for the toner and the carrier is excellent. If the absolute specific gravity of the toner is under 1.35 g/cm$^3$, it is very difficult to capture the toner in the pulverizing and the classifying processes. Therefore, the productivity (pulverization) for the toner becomes worse and the stirring efficiency for the toner and the carrier is reduced because the specific gravity difference between the toner and the carrier becomes large. As a result, it is impossible to achieve an improvement for charging the toner and a stable effect of the charging state.

If the absolute specific gravity of the toner is larger than 1.6 g/cm$^3$, the required weight of the toner for obtaining a solid image in a predetermined image concentration per unit area becomes large, and therefore, the cost increases. In addition, because the resin concentration in the toner becomes lower, the fixing strength to the paper for the toner reduces since the fixation property depends on the resin concentration. Therefore, the toner detaches from the fixed image such that the image is disordered and the image degradation, such as the bleed, occurs. The absolute specific gravity can be measured by a gravitometer, such as an air comparison type gravitometer (made by Beckmann, MODEL-930).

The carbon black is usually agglomerated to form a secondary condenser and this condenser has to be uniformly dispersed in the primary particles. However, it is very difficult to disperse the condenser in the primary particles. Generally, the toner that is agglomerated to the primary condenser or its similar state does not exist too much. As a result, the dispersion is not always sufficient and therefore, the charge amount of the toner is not uniformly distributed and the toner is easily greased and scattered. Accordingly, regarding the black toner, instead of the carbon black etc used as the coloring agent conventionally, the metal material used in the invention can achieve an unexpected result.

According to the invention, the metal material having a low saturated magnetization intensity is preferred. If the saturated magnetization intensity is high, the metal materials (particles) are easily agglomerated by the magnetic force and the magnetization intensity of the toner becomes larger too. Because the constraint force acting on the toner due to the magnets in the developing sleeves becomes too large, the developing amount of the toner onto the image support becomes small and therefore, the image concentration is reduced.

It is preferred that the grain size of the toner is 2.5~12 μm (average grain size per volume) in order to obtain a superior image quality in the fine line reproduction according to the invention. In particular, because the absolute specific gravity of the toner is as high as 1.35~1.6 g/cm$^3$, the can be easily captured in the pulverizing and the classifying processes and therefore, the toner has excellent properties in the pulverization and in the productivity for making the toner with a small grain size. The average grain size per volume for the toner can be measure by various methods and in the invention, the COULTER COUNTER TAII (made by Coulter Electronics Company, USA) is used as an example. The method for making the toner in the invention is not limited. In addition to the pulverization method, the polymerization method can be also used, or the two methods can be used together.

The material used for the toner of the invention will be described in detail. The resin that forms the toner can be a variety of resins in the following description. However, the polyester resin is particularly preferred in the invention. The polyester resin is characterized by its property of sharp melt. Even though a resin with a low molecular weight, its cohesive force is still large and therefore the polyester resin can easily have both the low temperature fixation and the offset resistance properties. However, not only can the polyester resin be used. Other resin can be used together with the polyester resin, but only if the good properties of the polyester resin are not damaged. Therefore, it is preferred that the percentage of polyester resin is higher than 80% in binding resin.

A polycondensation process of alcohol and carboxylic acid can obtain the polyester resin used in the invention. For example, alcohol can be a glycol type, such as ethylene glycol, diethylene glycol, triethylene glycol, propylene glycol etc, 1,4-bis(hydroxy methyl) cyclohexane, and a etherealized bisphenol type. Other examples for alcohol are two-valent alcohol monomer, and multi-valent alcohol monomer (above 3 valences). Examples for carboxylic acid can be an organic acid monomer, such as maleic acid, fumaric acid, phthalic acid, isophthalic acid, terephthalic acid, succinic acid, malonic acid, etc; and a multi-valent carboxylic acid monomer, such as 1,2,4-benzene tricarboxylic acid, 1,2,5-benzene tricarboxylic acid, 1,2,4-cyclohexane tricarboxylic acid, 1,2,4-napthalic tricarboxylic acid, 1,2,5-hexane tricarboxylic acid, 1,3-dicarboxylic-2-methylene carboxy propane, 1,2,7,8-octane tetracarboxylic acid, etc.

The polyester resin can be used alone, but it is preferred to use more than two polyester resins. As described above, more than two resins, for example the resin containing the insoluble matter of chloroform and the resin containing no insoluble matter, can be preferably used. Therefore, the toner suitable for low temperature fixation and offset resistance can be easily obtained.

Considering the thermal preservation, it is better that the polyester resin has a glass transition temperature Tg higher than 55° C., and higher than 60° C. is preferred. The glass transition temperature Tg can be measured by "Rigaku THERMOFLEX TG8110" (made by Rigaku Denki Company, Japan) with a temperature increment of 10° C./min.

As described above, the polyester resin is the most preferable resin for the resin component in the toner. However, if the toner satisfies the above viscoelasticity, the other resin rather than the polyester resin can be used too, and the low temperature fixation can be achieved. In addition, the other resin can be used together with the polyester resin if the toner properties are not affected.

In addition to the polyester resin, other resin examples are as follows. These resins can be used individually, or more than two resins can be combined. The example is a styrene type resin (homopolymer or copolymer that contains styrene or styrene substitution), such as poly-styrene, chloro polystyrene, poly α-methyl styrene, styrene/chlorostyrene copolymer, styrene/propylene copolymer, styrene/butadiene copolymer, styrene/vinyl chloride copolymer, styrene/vinyl acetate copolymer, styrene/maleic acid copolymer, styrene/ester acrylate copolymer (styrene/methyl acrylate copolymer, styrene/ethyl acrylate copolymer, styrene/butyl acrylate copolymer, styrene/octyl acrylate copolymer, styrene/phenyl acrylate copolymer, etc), styrene/ester methacrylate copolymer (styrene/methyl methacrylate copolymer, styrene/ethyl methacrylate copolymer, styrene/butyl methacrylate copolymer, styrene/phenyl acrylate copolymer, etc), styrene/α-methyl chloroacrylate copolymer, styrene/acrylonitrile/ester acrylate copolymer.

Other examples are viny chloride resin, styrene/vinyl acetate copolymer, rosin meta maleic acid resin, phenol resin, epoxy resin, polyethylene resin, polypropylene resin, ionomer resin, polyurethane resin, silicon resin, keton resin, ethylene/ethyl acrylate copolymer, xylene resin, polyvinyl butyal resin, petroleum resin, petroleum adding hydrogen etc.

The method for making the resin above is not particularly limited. Any one of bulk polymerization, solution polymerization, emulsion polymerization, and suspension polymerization etc. can be used. Similar to the polyester resin, considering the thermal preservation, that the resin has a glass transition temperature Tg higher than 55° C. is better, and higher than 60° C. is preferred.

At least one type of compounds of elements of Mn, Ti, Cu, Si, C are selected to coat on the surface of at least one of hematite, maghemite, or manganese oxide to use as the metal material. Especially [[γ]] $Mn_2O_3$ is used as manganese oxide. Lead (Pb), tin (Ti), aluminum (Al), antimony (Sb), sodium (Na), magnesium (Mg), phosphorus (P), sulfur (S), calcium (Ca), chromium (Cr), cobalt (Co), selenium (Se), beryllium (Be), bismuth (Bi), cadmium (Cd), nickel (Ni), tungsten (W), vanadium (Va), zinc (Zn), carbon (C) etc can further be added to the metal material. In addition, the well known azine colors (such as carbon black, oil furnace black, channel black, lamp black) and the black coloring agent (such as metal azo colors) can be used together. The blue coloring agent, such as copper phthalocyanine blue etc, can be also added to use as a complementary color.

All well known releasing agents can be used in the toner of the invention. In particular, the camauba wax of de-free fatty acid type, the montan wax and the rice wax oxide can be used alone or in combination. Preferably, the carnauba wax is a microcrystal and has an acid value smaller than 5. The montan wax is purified from the general mineral and also a microcrystal similar to the carnauba wax. Preferably, the montan wax has an acid value about 5~14. The rice wax oxide is obtained by oxidation of the rice and wax in the air, and preferably has an acid value about 10~30. The other releasing agent can be obtained by mixing the solid silicon varnish, the high-grade fatty acid alcohol, montan ester wax and the polypropylene wax with a low molecular weight etc. The amount of the releasing agent relative to the toner resin is 1~20 weight parts, and 3~10 weight parts is preferred.

A charge controlling agent or a flowability modifier can be also added to the toner of the invention, if necessary. The charge controlling agent can be a polarity controlling agent consisting of the well known materials, such as the nigrosin dye, the metallic complex salt dye, the class 4 ammonium salt etc, which can be used alone or mixed. The amount of the polarity controlling agent relative to the toner resin is 0.1~10 weight parts, and 1~5 weight parts is preferred. In particular, metal complex salicylate, which is preferably a complex having metal with a valence higher than 3 and a six coordination configuration. The complex is not only a charge controlling agent, by reacting with a high reactive portion of the resin and the wax to create a slight bridging structure, but an improved effect for the hot offset resistance is also obvious. The examples for metals having a valence higher than 3 are Al, Fe, Cr and Zr etc. Additionally, the flowability modifier can be a silicon oxide, a silicon carbide, an aluminum oxide, a titanium barium oxide etc, which can be used alone or mixed. The amount of the flowability modifier relative to the toner resin is 0.1~5 weight parts, and 0.5~2 is preferred.

The toner of the invention can be applied to the one component developing agent, or to the two component developing agent together with a carrier. When the toner is used in the two component developing agent, all of the well known materials can be used as the carrier. For example, magnetic powders (such as the iron powders, ferrite powders, and nickel powders etc), glass beads, or magnetic powders and glass beads with their surfaces coated with the resin etc.

The resin for coating on the carrier of the invention can be styrene-acryl copolymer, silicon resin, mallein resin, fluorine resin, polyester resin and epoxy resin, for example. For the styrene-acryl copolymer, it is preferred that the percentage of the styrene is about 30~90 weight percentage (w %). If the styrene is lower than 30 w %, the developing property is reduced; and if the styrene exceeds 90 w %, the coating film becomes too hard and is easily separated, thereby the life-time of the carrier is reduced. In addition to the resin above, the resin coating of the carrier can further comprise adhesive, curing agent, lubricant, conductive material, and charge controlling agent etc.

No matter whether the toner of the invention is used in the one component developing agent or in the two component developing agent, the toner is cintained within a container. The container contained with the toner can be separately transported, and then installed in an image forming apparatus by a user. The container above is not particularly limited. For example, a bolt shape or cartridge shape can be used. In addition, the apparatus for forming images by electrophotography is not limited, which can comprise the copy machine or the printer.

<<Second Embodiment>>

Figure 2:
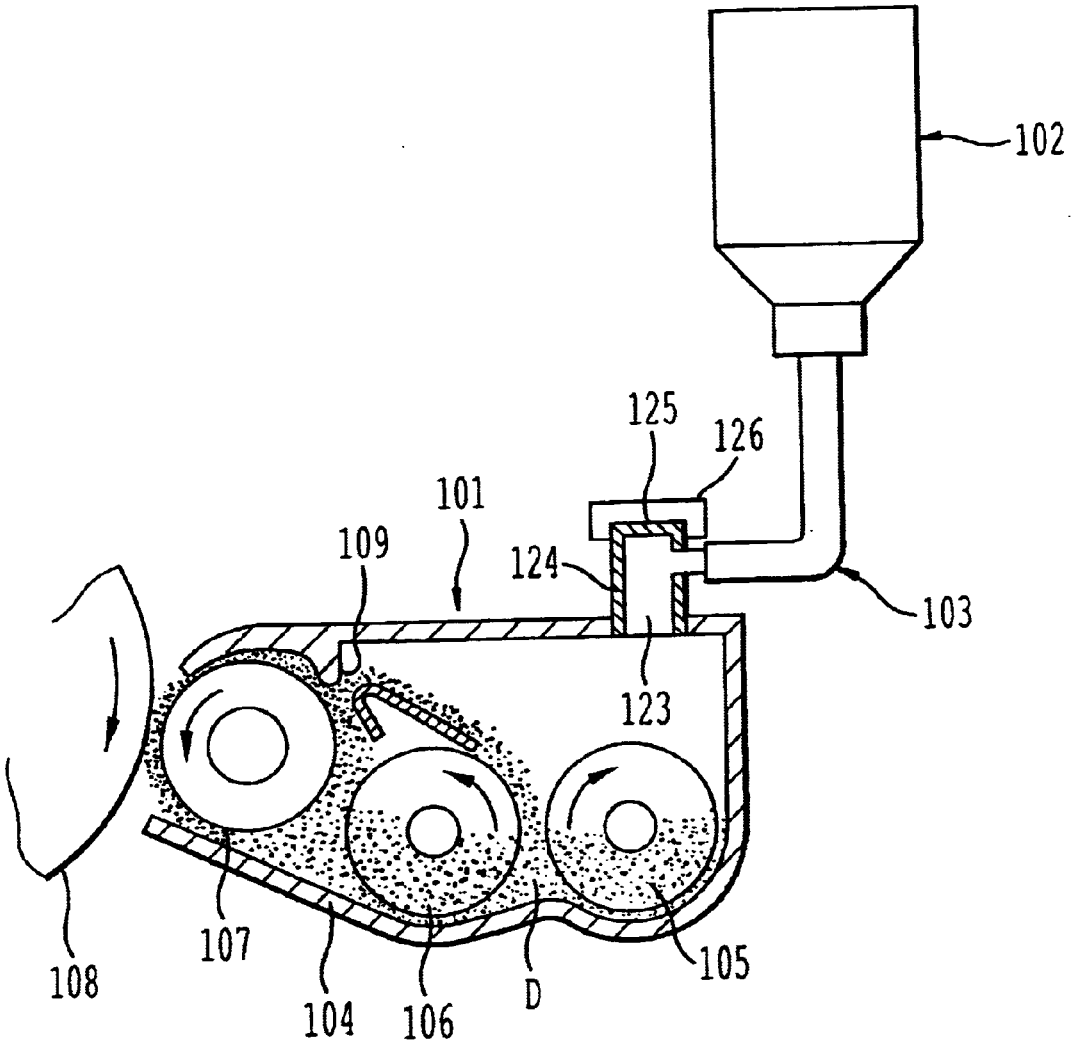
FIG. 2 schematically shows an image forming apparatus that installs a container containing with a developing agent for electrophotography according to the invention.

The image forming apparatus of the invention will be described in detail by referring to the drawings. FIG. 2 schematically shows an image forming apparatus that installs a container contained with a developing agent for electrophotography according to the invention. FIG. 2 is a cross-sectional view of a developing unit 101 installed inside the image forming apparatus, a container 102 for containing the developer and a transporting device 103 for transporting the developer between the container 102 and the developing unit 101.

Referring to FIG. 2, the developing unit 101 comprises a developing housing 104, a first and a second screw 105, 106 and a developing roller 107. The developing housing 104 is used for containing a liquid two component developer D that is mixed by the toner and the carrier. The first and the second screws 105, 106 are used for stirring and mixing the developer D. The developing roller 107 is arranged to be opposite to a photosensitive member 108 of a latent image. The photosensitive member 108 is driven to rotate along the arrow direction such that a electrostatic latent image is formed on the surface of the photosensitive member 108. A cap 126 is fitted to a connecting member 124 with or without a filter 125. In addition, well known devices, such as a charging device, an exposing device, a transcribing device, a charge removing device, and a cleaning device etc (not shown), can be further arranged around the photosensitive member 108.

The developer D in the developing housing 101 is stirred by the rotation of the first and the second stirring screws 105, 106. The toner collides with the carrier to generate a triboelectricity having an opposite parity to the carrier. The developer D is then supplied onto the surface of the developing roller 107 that is driven to rotate in the arrow direction (counterclockwise). The supplied developer D is supported by the surface of the developing roller 107 and then is transported along the rotational direction by the rotation of the developing roller 107. The amount of the transported developer D can be regulated and controlled by a doctoral blade 109. The regulated developer D is then transported to a developing region between the developing roller 107 and the photosensitive member 108. By electrostatic induction, the toner in the developer D is migrated to the electrostatic latent image on the surface of the photosensitive member 108, and then the electrostatic latent image is visualized as a toner image.

Figure 4:
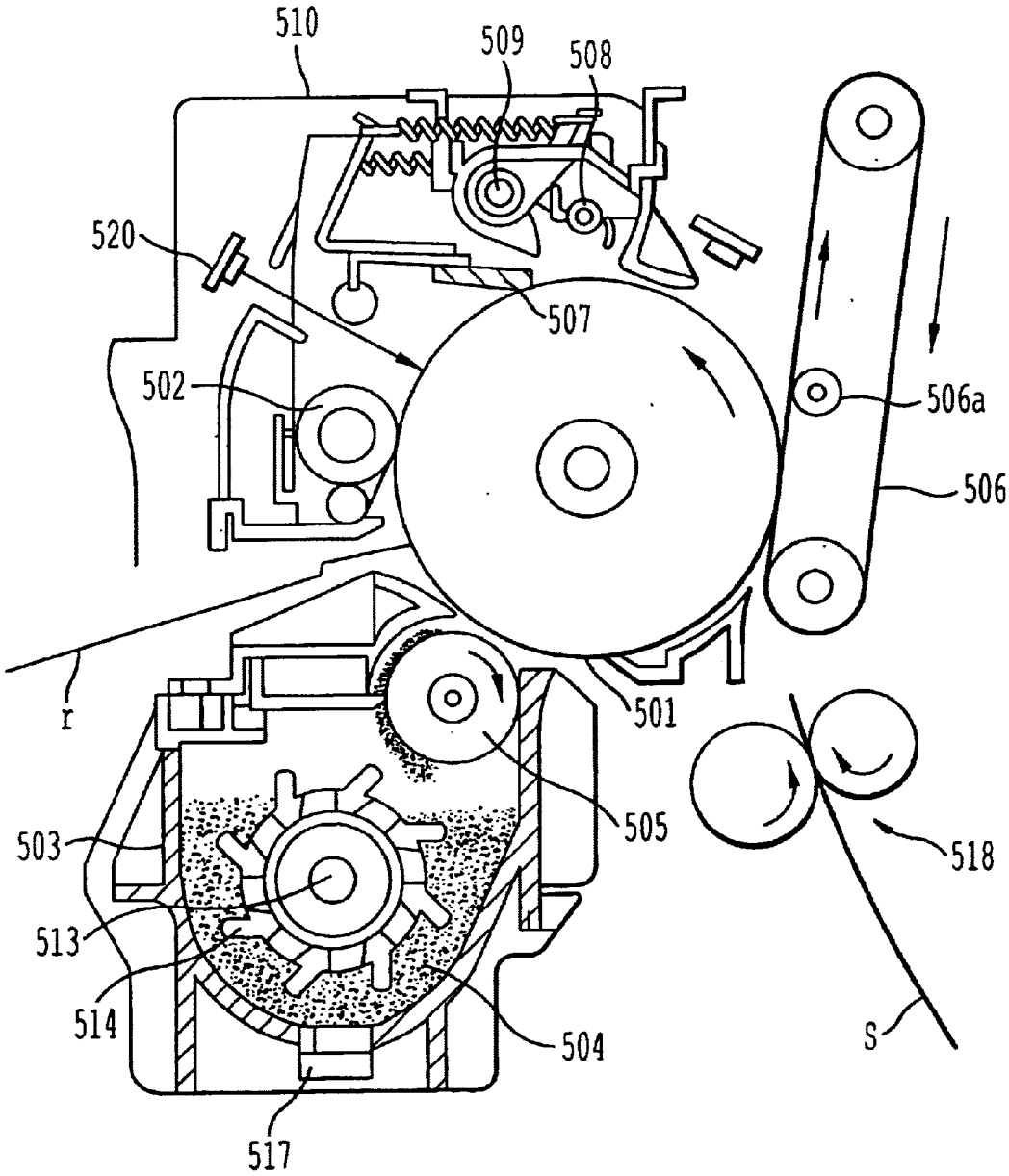
FIG. 4 schematically shows an example according to the image forming apparatus and method of the invention.

The image forming apparatus and method of the invention will be described in detail by referring to the drawings. FIG. 4 schematically shows an example according to the image forming apparatus and method of the invention.

Referring to FIG. 4, a photosensitive member 501 used as an image supporter in a photosensitive and cleaning unit (PCU) 510 is rotated along the arrow direction (counterclockwise), and then is charged by a charging roller 502. An original image is exposed by an exposure device (not shown), or is illuminated by a laser beam of an optical writing device (not shown) to obtain an exposure image, and then an electrostatic latent image is formed on the surface of the photosensitive member 501. The developing device 503 further comprises a transporting screw 513 having a paddle 514, and the toner concentration can be detected by a toner sensor 517. The developer 504 is filled into the developing device 503. The developer 504 is a two component developer that is mixed by the toner and the carrier. When the developer 504 is stirred, the toner is charged because of frictional electricity. In the developing device 503, a developing sleeve 505 is installed at a position opposite to the photosensitive member 501. Inside the developing sleeve 505, a magnetic roller having a plurality of magnets or magnetic poles is installed. The developer 504 is supported by the developing sleeve 505, and then transported to an opposite position (the photosensitive member 501). The electrostatic latent image on the photosensitive member 501 is therefore developed by the toner.

A transcribing belt 506 is installed along the rotational direction of the photosensitive member 501 and the downstream side of the developing device 503. The transcribing belt 506 is supported by a driving roller and a linking roller and then rotated along the arrow direction. In addition, the transcribing belt 506 can be attached or detached to the photosensitive member 501 by a clutching device (not shown). When transcribing, the transcribing belt 506 is in contact with the photosensitive member 501 to form a nip, and a transcription paper S is transported. Furthermore, a bias roller 506*a* is installed to be in contact with the inner surface of the transcribing belt 506, and is used for applying a voltage with a reverse polarity (transcribing output) to the transcribing belt 506 by a power supply (not shown).

The transcription paper S transported from a paper feeding unit (not shown) is fed to the nip between the photosensitive member 501 and the transcribing belt 506 by a resist roller 518 according to an image forming timing to the photosensitive member 501. By an electric field generated between the photosensitive member 501 and the transcribing belt 506, the image is transcribed onto the transcription paper S sandwiched by the photosensitive member 501 and the transcribing belt 506. Afterwards, the transcription paper S that the toner image has been transcribed to is transported by the transcribing belt 506 and then passed through a fixing unit (not shown). At this time, the toner image on the transcription paper S is thermally melted. After fixing, the transcription paper S is ejected by an ejecting unit (not shown). The toner, that remains on the photosensitive member 501 and is not transcribed, is blocked by a cleaning blade 507, and then absorbed to a recycle coil 509 by a recycle spring 508. By the recycle coil 509, the recycled toner returns to the developing device 503. After cleaning, charges on the photosensitive member 501 are removed by a charge removing lamp 520. The image forming apparatus further comprises a sensor (P sensor) for detecting a reflection concentration. This disclosure of the invention can be also applied to a color electrophotographic and copy apparatus.

Figure 3:
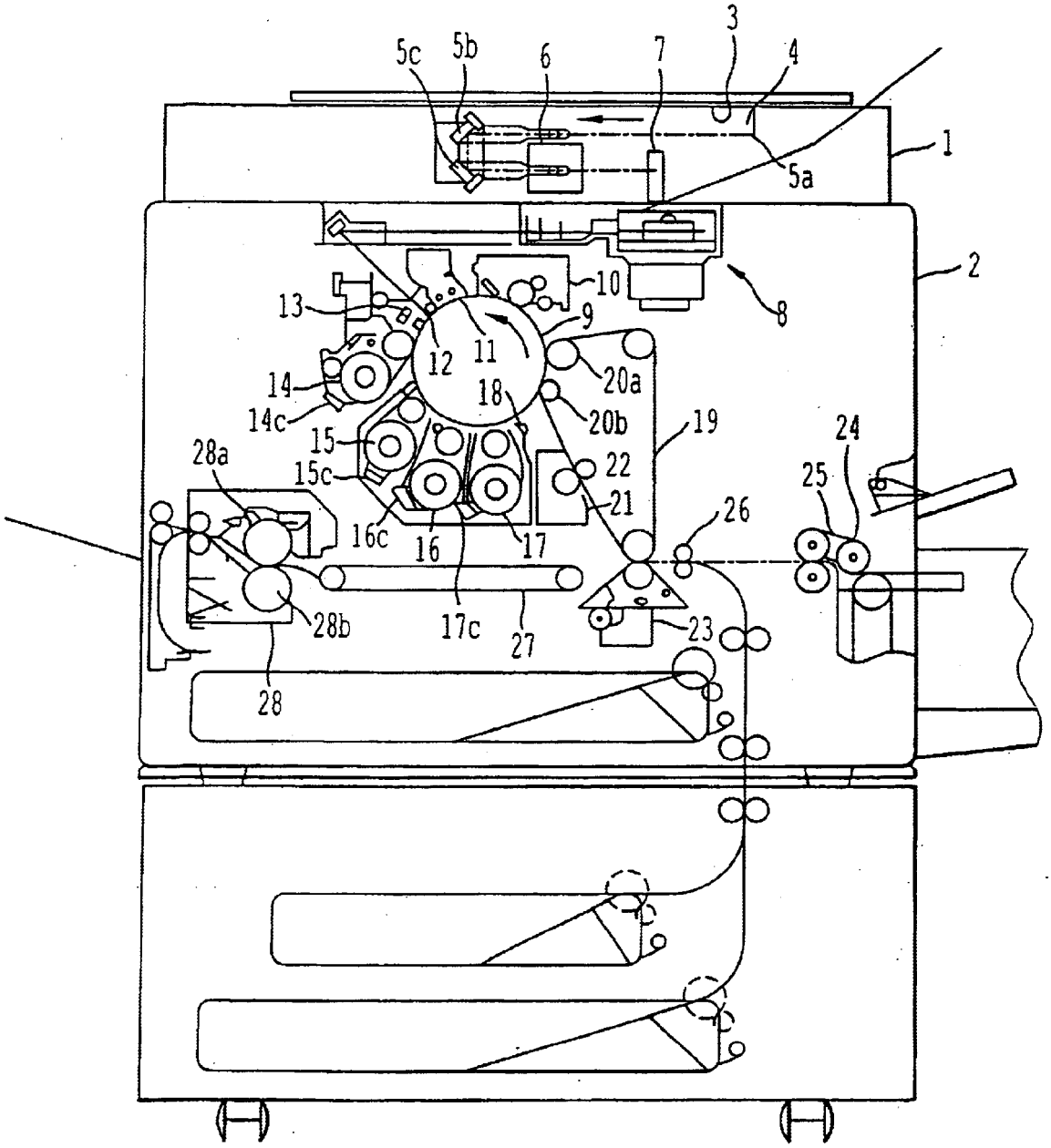
FIG. 3 shows an exemplary cross-sectional view of the color electrophotographic and copy apparatus.

FIG. 3 shows an exemplary cross-sectional view of the color electrophotographic and copy apparatus. Referring to FIG. 3, the color image reading apparatus 1 forms an image of an original image 3 on a color sensor 7 through an illuminating lamp 4, mirror sets 5*a*, 5*b*, 5*c*, and a lens 6. The color information of the image of the original 3 is divided into several colors, for example red (R), green (G) and blue (B). The colors R, G, B are then respectively read and converted to electronic image signals. According to signal levels of the colors R, G, B of the image signals, a color transform process is performed by an image processing unit (not shown) to obtain a color image data consisting of black (Bk), cyan (C), magenta (M) and yellow (Y).

According to the color image data (Bk, C, M, Y), a toner image with a full color is formed on a transcribing sheet. In a color image printing apparatus 2 shown in FIG. 3, a photosensitive member 9 rotates counterclockwise as the arrow direction. A photosensitive member cleaning unit 10 (containing a charge remover used before cleaning), a charge removing lamp 11, a charging unit 12, a potential sensor 13, a black developing unit 14, a cyan developing unit 15, a magenta developing unit 16, a yellow developing unit 17, an optical sensor 18 for detecting a developing concentration pattern, and an intermediate transcribing belt 19 are arranged around the photosensitive member 9. Each of the developing units 14, 15, 16, 17 further comprises a developing sleeve, a developing paddle and a toner concentration sensor (14*c*, 15*c*, 16*c*, 17*c*) for developer. The developing sleeve rotates so that the developer is in contact with the surface of the photosensitive member 9 for developing an electrostatic latent image. The developing paddle rotates for draining and stirring the developer. The developers for the electrophotography are contained within developing units 14, 15, 16, 17, respectively.

The black image data is transmitted to the color image printing apparatus 2 and then transformed to an optical signal by an optical writing unit 8. By performing an optical writing process using a laser beam to the photosensitive member 9, an electrostatic latent image of the black image is formed on the photosensitive member 9 (for example, −80V~−130V for the image part and −500V~−700V for the non-image part). Before the front end of the electrostatic latent image reaches a developing position of the black developing unit 14, the black image of the electrostatic latent image is developed by starting to rotate the black toner on the developing sleeve, and therefore a black toner image is formed on the photosensitive member 9. At the time point that the rear end of the electrostatic latent image passes the developing position, the black developing unit 14 is then deactivated for standby.

The black toner image formed on the photosensitive member 9 is transcribed by an intermediate transcribing belt unit onto the surface of the intermediate transcribing belt 19 that is driven with a constant speed relative to the photosensitive member 9. In FIG. 3, the intermediate transcribing belt 19 is supported by a driving roller 21, a transcribing bias roller 20*a*, a grounding roller 20*b* and a linking roller set, and is controlled and driven by a driving motor.

The intermediate transcribing belt 19 uses a material of fluorine resin ETFE (ethylene-tetra fuloro-ethylene) with carbon dispersion, for example, and preferably has a volume resistant rate of $10^9$ Ωcm. Preferably, the transcribing bias roller 20*a* has volume resistant rate of $10^9$ Ωcm, and can be formed by covering a PFE tube over a hydrin gum roller, for example. The axis of the grounding roller 20*b* is grounded.

The transcription of the toner image from the photosensitive member 9 to the intermediate transcribing belt 19 is performed by applying a predetermined bias voltage to the transcribing bias roller 20*a*. At this time, the photosensitive member 9 and the intermediate transcribing belt 19 are tightly in contact because the intermediate transcribing belt 19 is pressed to be in contact with the photosensitive member 9 by the transcribing bias roller 20*a* and the grounding roller 20*b*.

The intermediate transcribing belt 19 is grounded by the grounding roller 20*b*. The affect of the electric field due to the transcribing bias applied by the transcribing bias roller 20*a* can be within the tight contact portion between the intermediate transcribing belt 19 and the photosensitive member 9. Therefore, before the intermediate transcribing belt 19 is tightly in contact with the photosensitive member 9, the electric field cannot affect the toner image on the photosensitive member 9 and the gaps between the toner particles due to the electric field generated by the transcribing bias roller 20*a* can be prevented from increasing, i.e., the gaps in the toner image can be prevented.

After the black toner image is transcribed onto the intermediate transcribing belt 19, the photosensitive member 9 is then cleaned by the cleaning unit 10, and then is charged by the charging unit 12 after the charges on the photosensitive member 9 are uniformly removed by the charge removing lamp 11. Next, the cyan image data is transmitted to the color image printing apparatus 2, and then transformed to an optical signal by an optical writing unit 8. By performing an optical writing process using a laser beam to the photosensitive member 9, an electrostatic latent image of the cyan image is formed on the photosensitive member 9.

Similar to the operation of the black developing unit 14, the electrostatic latent image of the cyan image is also developed by the cyan developing unit 15, and then a cyan toner image is formed on the photosensitive member 9. Similar to the black toner image, the cyan toner image formed on the photosensitive member 9 is transcribed on the surface of the intermediate transcribing belt 19 where the black toner image has been formed. Namely, the position of the cyan toner image is consistent with that of the black toner image. Thereafter, by the same procedure, the magenta toner image and the yellow toner image are sequentially formed on the surface of the intermediate transcribing belt 19 where image formation position is consistent with that where the black and cyan toner images have been formed. Accordingly, a full color toner image is formed on the surface of the intermediate transcribing belt 19.

The fall color toner image formed on the surface of the intermediate transcribing belt 19 is then transcribed on a transcription sheet, which will be described in detail as follows. Referring to FIG. 3, a transcribing unit 23, used for transcribing the toner image from the intermediate transcribing belt 19 to the transcription sheet 24, comprises a clutching unit consisting of a transcribing bias roller, a roller cleaning blade, and a belt. Generally, the bias roller is detached from the belt surface. When the full color toner image formed on the intermediate transcribing belt 19 is being transcribed onto the transcription sheet, the bias roller presses the belt surface by the clutching unit by applying a predetermined bias voltage to the bias roller according to a proper timing. Accordingly, the full color toner image formed on the intermediate transcribing belt 19 is transcribed onto the transcription sheet 24.

As shown in FIG. 3, the transcribing sheet is fed by a feeding roller 25 and a resist roller 26 according to a timing such that the front end of the full color toner image formed on the intermediate transcribing belt 19 reaches a transcribing position to the transcribing sheet 24. The belt cleaning unit 22 comprises a clutching device etc consisting of a brush roller, a gum blade and a belt. When each color toner image is transcribed onto the intermediate transcribing belt 19, the belt surface of the belt cleaning unit 22 is detached from the intermediate transcribing belt 19 by the clutching device. After the toner image is transcribed from the intermediate transcribing belt 19 onto the transcription sheet 24, the belt cleaning unit 22 is pressed to be in contact with the intermediate transcribing belt 19 by the clutching device, so that the surface of the intermediate transcribing belt 19 can be cleaned.

As shown in FIG. 3, the transcription sheet 24, that the full color toner image has been transcribed thereon, is transported to a fixing unit 28 by a transporting unit 27. A fixation process for the full color toner image is performed by a pressing roller 28*b* and a fixing roller 28*a* that is controlled at a predetermined temperature. For the fixation process, it is preferred that fixing roller 28*a* can supply the heat at the same time when the pressing roller 28*b* presses. The temperature of the fixing roller 28*a* is preferred to be set at about 160° C.~190° C. If the temperature of the fixing roller 28*a* is set below 160° C., the toner will not be smoothly softened and gaps remain. In addition, if the temperature of the fixing roller 28*a* is set higher than 190° C., the heat supply to the fixing roller 28*a* may not be followed in the continuous copy. Considering the process speed, the temperature of the fixing roller 28*a* can be preferably set at about 170° C.~185° C. If the temperature is set at the above range, the temperature unevenness of the fixing roller 28*a* can be reduced, and a fixed toner image with a stable quality can be obtained.

In the foregoing description, the fall color toner image is obtained by four color image data: black, cyan, magenta and yellow. However, even in two color or three color mode, the electrostatic latent image can be formed based on the assigned color mode. Each color developing unit is activated and the toner image can be formed on the transcription sheet as the operation described above. Additionally, when a mono color toner image is formed on the transcription sheet, only the corresponding developing unit is activated. At this time, even if the intermediate transcribing belt 19 is driven to be in contact with the photosensitive member 9 and the cleaning unit 22 is also in contact with the intermediate transcribing belt 19, the image formation operation can be still performed.

The method for making the toner is described in the following examples. However, these examples are not used for limiting the scope of the invention. In the following examples, the parts means the weight parts.

EXAMPLE 1

| | |
|---|---|
| polyester resin A (monomer: PO/EO additive of bisphenol A terephthal acid/trimellitic hydride, Tg: 62° C.) | 60 parts |
| polyester resin B (monomer: PO/EO additive of bisphenol A, terephthal acid/trimellitic hydride, Tg: 61° C.) | 30 parts |
| polethylene-styrene/acryl graft copolymer (monomer: polyethylene, styrene, methyl acrylate, Tg: 61° C.) | 10 parts |
| carnauba wax of de-free fatty acid type (melt point: 83 ° C.) | 5 parts |
| hemaatite particle A containing Mn Ti, Cu, Si, C (average length of the short axis of the primary paticle: 0.03 μm, a spherical particle with a degree of sphericity of 1.4, absolute specific gravity of 4.5 g/cmhu 3 | 20 parts |

After the toner materials are sufficiently stirred and mixed in a mixer, then mixed by a dual axial extrusion machine, pulverized and classified after cooling, a toner preform is obtained. Thereafter, hydrophobic silica 0.5 wt % and titanium oxide 0.3 wt % are added and mixed into the toner preform to obtain a final product of the toner.

EXAMPLE 2

Except that the hematite particle A containing Mn, Ti, Cu, Si, C (20 parts) in the example 1 for making the toner is replaced by a hematite particle B containing Mn, Ti, Cu, Si, C, 20 parts (average length of the short axis of the primary particle: 0.5 μm, a spherical particle with a degree of sphericity of 1.3, absolute specific gravity of 4.4 g/cm$^3$), the other conditions are the same as example 1.

EXAMPLE 3

Except that the hematite particle A containing Mn, Ti, Cu, Si, C (20 parts) in the example 1 for making the toner is replaced by a maghemite particle C containing Mn, Ti, Cu, Si, C, 20 parts (average length of the short axis of the primary particle: 0.12 μm, a spherical particle with a degree of sphericity of 1.5, absolute specific gravity of 4.6 g/cm$^3$), the other conditions are the same as example 1.

EXAMPLE 4

Except that 20 parts of the hematite particle A containing Mn, Ti, Cu, Si, C in the example 1 is replaced by 20 parts of [[γ]] $Mn_2O_3$ particle A containing Fe, Ti, Cu, Si, C (average length of the short axis of the primary particle: 0.08 μm, needle particle with a axial ratio of 3.2, absolute specific gravity of 4.4 g/cm$^3$), the other conditions are the same in as example 1.

EXAMPLE 5

Except that 20 parts of the hematite particle A containing Mn, Ti, Cu, Si, C in the example 1 is replaced by 20 parts of a hematite particle D containing Mn, Ti, Cu, Si, C (average length of the short axis of the primary particle: 0.05 μm, needle particle with a axial ratio of 3.6, absolute specific gravity of 4.5 g/cm$^3$), the other conditions are the same as example 1.

EXAMPLE 6

Except that the condition during the pulverization process is changed, the other conditions are the same as example 1.

EXAMPLE 7

Except that 20 parts of the hematite particle A containing Mn, Ti, Cu, Si, C in the example 1 for making the toner is replaced by 20 parts of a magnetite particle A containing Mn, Ti, Cu, Si, C (average length of the short axis of the primary particle: 0.03 $\mu$m, a spherical particle with a degree of sphericity of 1.4, absolute specific gravity of 4.6 g/cm$^3$), the other conditions are the same as example 1.

EXAMPLE 8

Except that 20 parts of the hematite particle A containing Mn, Ti, Cu, Si, C in the example 1 for making the toner is replaced by 55 parts of a hematite particle E containing Mn, Ti, Cu, Si, C (average length of the short axis of the primary particle: 0.08 $\mu$m, a spherical particle with a degree of sphericity of 1.6, absolute specific gravity of 4.5 g/cm$^3$), the other conditions are the same as example 1.

EXAMPLE 9

Except that 20 parts of the hematite particle A containing Mn, Ti, Cu, Si, C in the example 1 for making the toner is replaced by 10 parts of carbon black (#44, made by Mitsubishi carbon company, Japan), the other conditions are the same as example 1.

EXAMPLE 10

Except that 5 parts of the camauba wax of de-free fatty acid type in the example 1 for making the toner is removed, the other conditions are the same as example 1.

EXAMPLE 11

Except that 5 parts of the carnauba wax of de-free fatty acid type in the example 1 for making the toner is replaced by 5 parts of polypropylene wax with a low molecular weight, the other conditions are the same as example 3.

EXAMPLE 12

Except that 20 parts of the hematite particle A containing Mn, Ti, Cu, Si, C in the example 1 is replaced by 20 parts of a maghemite particle A containing Mn, Ti, Cu, Si, C (average length of the short axis of the primary particle: 0.06 $\mu$m, needle particle with a axial ratio of 3.1, absolute specific gravity of 4.6 g/cm$^3$), the other conditions are the same as example 1.

EXAMPLE 13

Except that 20 parts of the hematite particle A containing Mn, Ti, Cu, Si, C in the example 1 for making the toner is replaced by 20parts of a [[$\gamma$-]] $Mn_2O_3$ particle B containing Fe, Ti, Cu, Si, C (average length of the short axis-of the primary particle: 0.041 $\mu$m, a spherical particle with a degree of sphericity of 1.5, absolute specific gravity of 4.4 g/cm$^3$), the other conditions are the same as example 1.

EXAMPLE 14

Except that 20 parts of the hematite particle A containing Mn, Ti, Cu, Si, C in the example 1 for making the toner is replaced by 20 parts of a maghemite particle B containing Fe, Ti, Cu, Si, C (average length of the short axis of the primary particle: 0.06 $\mu$m, a spherical particle with a degree of sphericity of 1.4, absolute specific gravity of 4.5 g/cm$^3$), the other conditions are the same as example 1.

EXAMPLE 15

Except the following toner materials are changed, the other conditions are as same as the Example 1.

| | |
|---|---|
| polyester resin C (monomer: PO/EO additive of bisphenol A, terephthal acid/trimellitic hydride, Tg: 55° C.) | 60 parts |
| polyester resin D (monomer: PO/EO additive of bisphenol A, terephthal acid/trimellitic hydride, Tg: 57° C.) | 30 parts |
| polyethylene-styrene/acryl graft copolymer (monomer: polyethylene, styrene, methyl acrylate, Tg: 61° C.) | 10 parts |
| carnauba wax of de-free fatty acid type (melt point: 83° C.) | 5 parts |
| hematite particle A containing Mn, Ti, Cu, Si, C | 4 parts |
| carbon black (made by Mitsubishi carbon company, #44 | 8 parts |

EXAMPLE 16

Except the following toner materials are changed, the other conditions are as same as the Example 1.

| | |
|---|---|
| polyester resin E (monomer: PO/EO additive of bisphenol A, terephthal acid/trimellitic hydride, Tg: 62° C.) | 60 parts |
| polyester resin F (monomer: PO/EO additive of bisphenol A, terephthal acid/trimellitic hydride, Tg: 62° C.) | 30 parts |
| polyethylene-styrene/acryl graft copolymer (monomer: polyethylene, styrene, methyl acrylate, Tg: 61° C.) | 10 parts |
| carnauba wax of de-free fatty acid type (melt point: 83° C.) | 5 parts |
| hematite particle A containing Mn, Ti, Cu, Si, C | 4 parts |
| carbon black (made by Mitsubishi carbon company, #44) | 8 parts |

EXAMPLE 17

Except the following toner materials are changed, the other conditions are as same as the Example 1.

| | |
|---|---|
| polyester resin G (monomer: PO/BO additive of bisphenol A, terephthal acid/trimellitic hydride, Tg: 63° C.) | 60 parts |
| polyester resin H (monomer: PO/BO additive of bisphenol A, terephthal acid/trimellitic hydride, Tg: 61° C.) | 30 parts |
| polyethylene-styrene/acryl graft copolymer (monomer: polyethylene, styrene, methyl acrylate, Tg: 61° C.) | 10 parts |
| carnauba wax of de-free fatty acid type (melt point: 83° C.) | 5 parts |
| hematite particle A containing Mn, Ti, Cu, Si, C | 4 parts |
| carbon black (made by Mitsubishi carbon company, #44) | 8 parts |

EXAMPLE 18

Except that 20 parts of the hematite particle A containing Mn, Ti, Cu, Si, C in the example 1 is replaced by 55 parts of a hematite particle F containing Mn, Ti, Cu, Si, C (average length of the short axis of the primary particle: 0.8 $\mu$m, a spherical particle with a degree of sphericity of 1.5, and absolute specific gravity of 4.5 g/cm$^3$), the other conditions are the same as example 1.

The properties of the toners in examples 1~18 are measured. The thermal properties measured by the flow tester is shown in Table 4, and the absolute specific gravity and the average size per volume is shown in Table 5.

TABLE 4

| Toner | thermal properties from the flow tester | | | |
|---|---|---|---|---|
| | softening point (° C.) | flow beginning point (° C.) | F1/2 point (° C.) | flow ending point (° C.) |
| Example 1 | 76 | 105 | 150 | 170 |
| Example 2 | 71 | 98 | 132 | 148 |
| Example 3 | 74 | 102 | 147 | 167 |
| Example 4 | 76 | 109 | 156 | 174 |
| Example 5 | 77 | 108 | 155 | 180 |
| Example 6 | 76 | 105 | 150 | 170 |
| Example 7 | 75 | 106 | 149 | 168 |
| Example 8 | 77 | 109 | 178 | 197 |
| Example 9 | 70 | 96 | 128 | 146 |
| Example 10 | 77 | 106 | 151 | 172 |
| Example 11 | 76 | 105 | 148 | 167 |
| Example 12 | 77 | 116 | 189 | 205 |
| Example 13 | 75 | 106 | 151 | 172 |
| Example 14 | 76 | 105 | 152 | 171 |
| Example 15 | 56 | 103 | 149 | 161 |
| Example 16 | 76 | 125 | 190 | 209 |
| Example 17 | 71 | 101 | 140 | 162 |
| Example 18 | 72 | 101 | 148 | 163 |

TABLE 5

| Toner | absolute specific gravity (g/cm$^3$) | average size per volume ($\mu$m) |
|---|---|---|
| Example 1 | 1.42 | 6.7 |
| Example 2 | 1.43 | 6.8 |
| Example 3 | 1.43 | 6.8 |
| Example 4 | 1.42 | 6.5 |
| Example 5 | 1.43 | 6.4 |
| Example 6 | 1.42 | 12.2 |
| Example 7 | 1.43 | 6.5 |
| Example 8 | 1.73 | 6.8 |
| Example 9 | 1.28 | 6.7 |
| Example 10 | 1.42 | 6.8 |
| Example 11 | 1.42 | 6.7 |
| Example 12 | 1.43 | 6.8 |
| Example 13 | 1.42 | 6.8 |
| Example 14 | 1.42 | 6.8 |
| Example 15 | 1.30 | 6.8 |
| Example 16 | 1.30 | 6.8 |
| Example 17 | 1.30 | 6.8 |
| Example 18 | 1.74 | 6.8 |

Example for Making the Carrier

| | |
|---|---|
| core material | 5000 parts |
| Cu-Zn ferrite particle (average size per volume: 45 $\mu$m) | |
| coat material | |

-continued

| | |
|---|---|
| toluene | 450 parts |
| silicon resin SR2400 | 450 parts |
| (made by Dow Coming Toray Silicone, 50% non-volatile) | |
| aminosilane SH6020 | 10 parts |
| (made by Dow Coming Toray Silicone) | |
| carbon black | 10 parts |

The coat materials are dispersed by a stirrer for 10 minutes to process a coat liquid. The coat materials and the core material are put into a coating apparatus, in which a rotational disc substrate and stirring vanes are installed in a flow bed for creating a swirl to perform the coating process. The coated liquid is coated on the core material, and then a baking process is performed for 2 hours at 250° C. in an electric furnace to obtain the carrier (the saturated magnetization is 65 emu/g when 3 kOe is applied, the remnant magnetization is 0 emu/g when 3 kOe is applied, specific resistance is $3.2\times10^8$ Ω·cm, and the average size per volume is 45 $\mu$m).

Example for Making the Developer 2.5 parts of the toner in any one of the examples 1~11 and 97.5 parts of the carrier above are mixed by a tubular mixer to obtain the developer.

The methods for evaluating the properties of the toners made according to the foregoing examples 1~11 are described as follows.

(1) Evaluation of the Fixation Property:

A teflon roller is used as the fixing roller to replace the fixing unit of the copy machine MF2000 (made by RICOH, Inc.). Paper of type 6200 (made by RICOH, Inc.) is loaded into the copy machine to perform a copy test. The result is shown in Table 6.

A cold offset temperature (low limit of the fixing temperature) and a hot offset temperature (offset resistance temperature) are obtained by varying the fixing temperature. Conventionally, the low limit of the fixing temperature for the toner with a low temperature fixation property is about 140° C.~150° C. The conditions for evaluating the low temperature fixation property are set with a linear feeding speed of 120~150 mm/sec, a surface pressure of 1.2 Kgf/cm$^2$, a nip width of 3 mm, and the conditions for evaluating the high temperature fixation property are set with a linear feeding speed of 50 mm/sec, a surface pressure of 2.0 Kgf/cm$^2$, a nip width of 4.5 mm.

(2) Evaluation of the Fine Line Reproduction:

The developer is contained in the copy machine MF2000 (made by RICOH, Inc.) to perform a copy test under the environment of normal temperature and normal relative humidity. The image evaluating test is performed for each developer.

In Embodiment 7, the developer of Example 8 is used. In Comparison example 6, the developer of Example 18 is used. However, in the Embodiment 7 and the comparison 6, low image density occurs.

According to the foregoing descriptions, the invention provides a toner, a developing method and apparatus that satisfy both the low temperature fixation property and the hot offset property and have a wide range of the fixing temperature, by which a very excellent result can be obtained.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A toner for an image formation, comprising:

at least one metal material in a binding resin, wherein the toner is measured by a stand-alone flow tester, and has a softening temperature of 65~77.5° C., a flow beginning temperature of 100~120° C., a melt temperature by a ½ method is 145~195° C., and an average length of a short axis of a primary particle of the at least one metal material is 0.01~0.4 $\mu$m;

wherein an absolute specific gravity of the at least one metal material is 4.0~5.0 g/cm$^3$.

2. The toner of claim 1, wherein the average length of a short axis of the primary particle of the at least one metal material is 0.01~0.1 $\mu$m.

3. The toner of claim 1, wherein the absolute specific gravity of the toner is 1.35~1.6 g/cm$^3$.

4. The toner of claim 1, wherein the at least one metal material has an anisotropic shape with an axial ratio above 2.

5. The toner of claim 1, wherein the at least one metal material has an isotropic shape with a degree of sphericity less than 2.

6. The toner of claim 1, wherein the amount of the at least one metal material is smaller than 50 weight parts with respect to a 100 weight part of the binding resin.

7. The toner of claim 1, further comprising an additive comprising at least one silica and/or a titanium oxide.

8. The toner of claim 1, wherein the binding resin comprises at least a polyester resin.

9. The toner of claim 1, further comprising a releasing agent.

10. The toner of claim 1, wherein the at least one metal material has at least one compound of elements selected from the group consisting of Mn, Ti, Cu, Si, and C on the surface of at least one of hematite, maghemite, or manganese oxide.

11. The toner of claim 1, wherein volume average grain size of the toner is 2.5~12 $\mu$m.

12. An image forming method, comprising: developing an electrostatic latent image formed on an image supporter of an image forming apparatus using the toner of claim 1.

* * * * *